US005639123A

United States Patent [19]

Medley et al.

[11] Patent Number: 5,639,123

[45] Date of Patent: Jun. 17, 1997

[54] CUSHIONED NOTE PAD HOLDER WITH ILLUMINATING DEVICE

[76] Inventors: Jeffrey D. Medley, 9539 Sandpiper West Dr., Indianapolis, Ind. 46268; Leroy D. Medley, 3358 Eden Village Pl., Carmel, Ind. 46033

[21] Appl. No.: 462,534

[22] Filed: Jun. 5, 1995

[51] Int. Cl.[6] ..... B42D 17/00

[52] U.S. Cl. ..... 281/44; 281/45; 281/51; 462/72

[58] Field of Search ..... 281/44, 45, 51; 402/79; 462/71, 72

[56] References Cited

U.S. PATENT DOCUMENTS 2,590,618 3/1952 Hodkin ..... 281/44

2,965,394 12/1960 Bresler ..... 281/44

5,100,178 3/1992 MacKelvie ..... 281/44

*Primary Examiner*—Willmon Fridie, Jr.

[57] ABSTRACT

The invention relates to a note pad holder used in bed, darkness, or the like. The integrated features include a padded outer frame and center webbing for support of a note pad of the removable, self-stick variety. The note pad is held in place by ridges molded into the padded frame and protruding from the inner surfaces of said frame. This allows for the note pad to be securely held in place while still providing access to the full top surface of the note. A notch in the padded frame is used to secure an illuminated writing device or other type of writing utensil. The padded nature of the holder and the access to an illuminated writing device provides the user with a safe, easy, and potentially lighted means of utilizing a note pad while in bed.

6 Claims, 3 Drawing Sheets

CUSHIONED NOTE PAD HOLDER WITH ILLUMINATING DEVICE

BACKGROUND OF THE INVENTION

The present invention relates to a holder for writing in bed and/or other conditions of darkness. More particularly, it relates to a two sided holder of non-permanently bound sheets, of thin, stiff material (hereinafter referred to as "note pad"), as in a "self-stick replaceable note pad", e.g. the 3M Corporation's "Post"-It® note pad, or part thereof, said holder surrounded on four sides by cylindrical cushions with a recessed slot for storing an illuminated writing device.

It is common with holders presently in use, that certain disadvantages prevent their providing convenient, safe, widespread availability of this ubiquitous memory support system during the time in which a user is in bed, darkness, or the like. Present note pad holders are of three types. The first type is the container type, e.g. a simple "rack, cradle, or box" (hereinafter referred to as "containers" ), which is primarily a stationary, desk-top accessory having the disadvantage of being unsuited for use in a bed due to it's rigidity, sharp corners, and lack of a light source to utilize during times of darkness. The second type of note pad holder is in the form of a "pocket, pouch or folder" (hereinafter referred to as "wallet"), which is primarily a portable holder for loose or bound note pads. The lack of stiffness in the wallet is a disadvantage to the utilization of non-permanently bound note pad, e.g. the "self-stick note pad", which shears into pieces when roughly handled, e.g. within the clothe covers of a bed while occupied. The wallet is further disadvantaged by requiring an opening manipulation to allow access to the note pad for note taking since the held material is held by the user required surface, e.g. the note pad face. Moreover, its disadvantage of lacking an alternative source of illumination and its small size, e.g. difficult to find within the clothe covers of a bed, further restricts the wallet type note pad holder's ability to provide widespread note pad availability for use in bed. The third type is the spring clip and/or clamp holder where the note material is retained from the front face and hence the self-stick note pad cannot be used. Further, the awkwardness of removing sheets from a clip type holder where the material is held by face contact makes it disadvantageous in bed due to the sharp edges of the clip device and the potential for inadvertent separation of the note pad from the note pad holder. Moreover, the lack of an alternative light source, again makes this type of note pad holder inconvenient to use in bed.

DESCRIPTION OF THE PRIOR ART

The U.S. Pat. No. 5,100,178 discloses a device comprising a frame fitted with compressible elements to provide a side holding force to releasably retain a note pad of the removable, self-stick variety. This device, however, displays the drawback that the frame with it's potentially sharp edges is not conducive to use in bed or any similar environment where it may come into contact with external parts of the human body. Moreover, the side holding force derived from a fitted compressible element, does not provide the manufacturing benefits gained by making the compressible elements a molded part of the outer frame.

SUMMARY OF THE INVENTION

It has been found that these disadvantages can be overcome if the note pad holder is comprised of a container like cradle with semicircular ridges extending from the sides of the cradle, parallel to the floor surface of the cradle. Said cradle and ridges being properly dimensioned as to securely hold a note pad in place while allowing for the pages of the note pad to still be removed. One side of the cradle would be notched as to allow access to one side of the note pad for easy removal using the thumb. The perimeter of the cradle would be encompassed within a portion of the circumference of cylindrical pads on all four sides with one pad notched to allow thumb access to the exposed side of the note pad. One cylindrical pad would have a slot running parallel to the associated side of the cradle which would accommodate an illuminated writing device. The slot would be lined be semicircular ridges, similar to those inside the cradle, which would hold the writing device securely in place until it is forcibly removed. There would be a second cradle, identical to the first, but positioned on the opposite side. The floors of the two cradles would be shared as well as the orientation of the notched cradle walls.

All parts of the proposed holder would be molded from the same rubber-like, flexible material. Molding the holder will allow for simplification of the manufacturing process. The soft, rubber-like material will be conducive to use in bed, darkness, or the like as there would be no sharp comers or edges to injure a user if the holder were inadvertently rolled upon or otherwise brought in contact with the user. The cylindrical nature of the pads allow for easy gripping with the none writing hand while the holder is in use. Moreover, the size of the pads allow the holder to be easily found underneath the clothe clovers of the bed while being small enough to stow under a pillow or the like while the holder is not in use. The two-sided aspect of the holder allows for two major benefits to the user. First, the second cradle allows for storage of an additional note pad for use when the first note pad has been depleted. Secondly, the two-sided nature allows both left and right handed users convenient access to the illuminated writing device due to the location of the writing device with respect to the user. Using one side of the holder allows the right handed user to grip the device with left hand while removing and utilizing the writing device with the right hand. Conversely, using the other side of the holder allows the left handed user to grip the device with the right hand while removing and utilizing the writing device with the left hand.

Thus, this note pad holder invention provides the user with convenient access to a memory support system during a time in which the user is in bed, darkness, or the like. Access to the writing device provides a source of illumination for the writing surface of the note pad which minimizes both interruptions to a partner sharing the same bed and the effort needed to locate and engage a light source outside the confines of the bed. Details of the novel features of the present invention are set forth in particular in the appended claims. The invention itself, however, will be best understood from the following description of preferred embodiments which is accompanied by the following drawings.

BRIEF DESCRIPTION OF THE DRAWINGS

FIG. 4 shows the thumb notches which can be seen on the far pad.

DETAILED DESCRIPTION OF THE DRAWINGS

Figure 1:
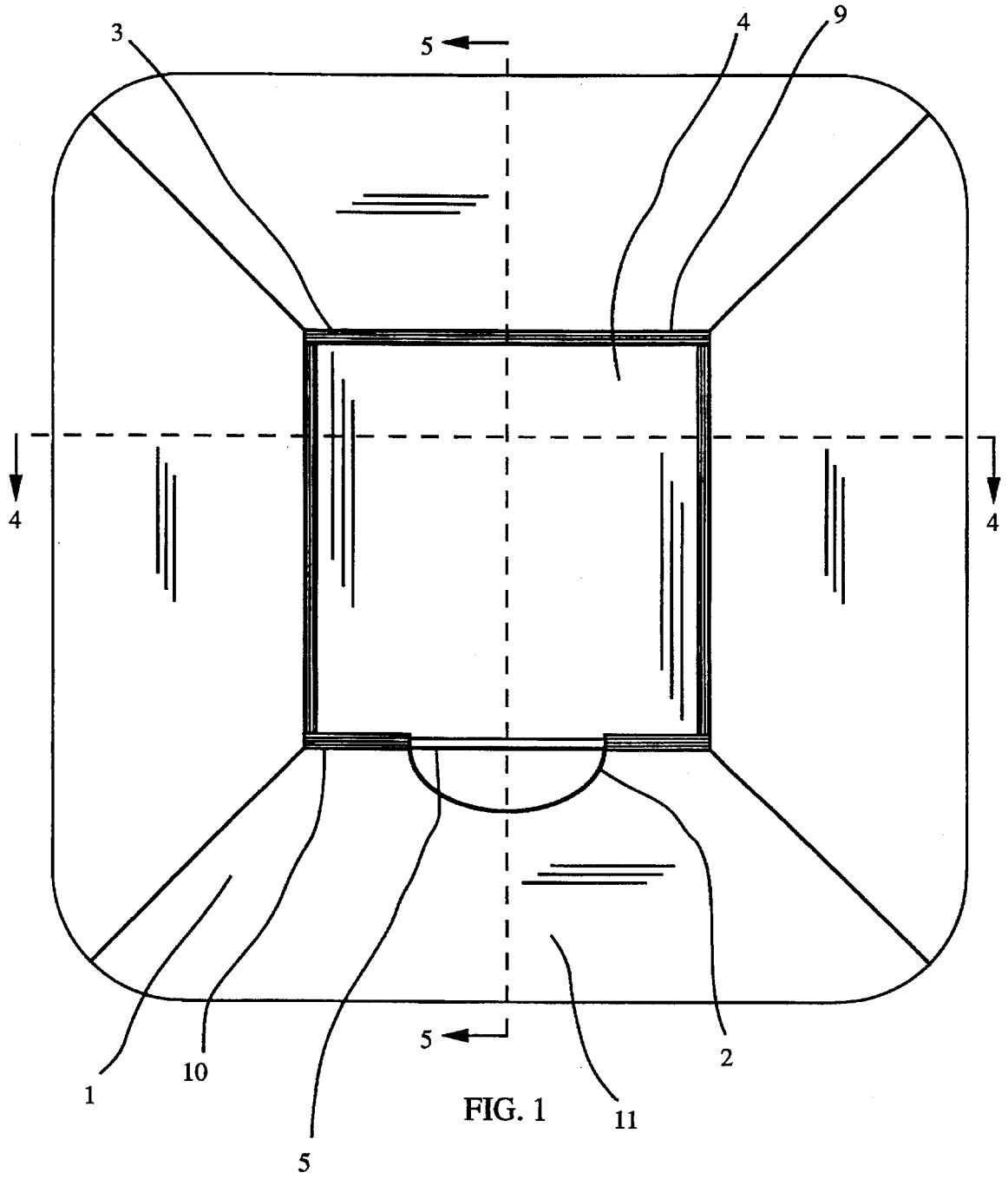
FIG. 1 is a front view of the preferred embodiment showing the cradle and surrounding pads

The note pad holder used in bed, darkness or the like has a rubber-like, flexible padding 1 of FIG. 1 encompassing a cradle floor web 5 filling the area at the center of the padding 1. The inner sides of the padding 1 make up the cradle walls 9 on both sides of the cradle floor web 5. Molded into these cradle walls 9 are semicircular ridges 3 running parallel to the cradle floor web 5. Along one cradle wall 10 and adjacent pad 11, a notch 2 passes through the pad 11 allowing access to a note pad 4 resting on the surface of the cradle floor web 5 and held in place by the semicircular ridges 3. Padding 1, ridges 3 and webbing 5 are all part of the same molded material that makes up this note pad holder. The diameter of the padding 1 could vary to allow for an easy, comfortable hand grip. The area within the padding 1 could vary allowing for different sized cradle webs 5 to support different sized note pads 4. This is accomplished by lengthening or shortening the pads 1 that make up the area of the inner cradle webbing 5. The webbing 5 is stiff enough to support the pressure of a writing device bearing down on the note pad 4. The ridges 3 protrude inward from the cradle walls 9 in such a way that secures the note pad 4 against dislodging when the holder is inverted or the like. The ridges 3 are aligned in rows up the cradle walls 9 to allow note pads of varying thicknesses to remain secured within the note pad holder. The notch 2 is sized in a way which allows a finger to be inserted. This provides access to the side of the note pad 4 and easy removal of individual sheets from note pad 4.

Figure 2:
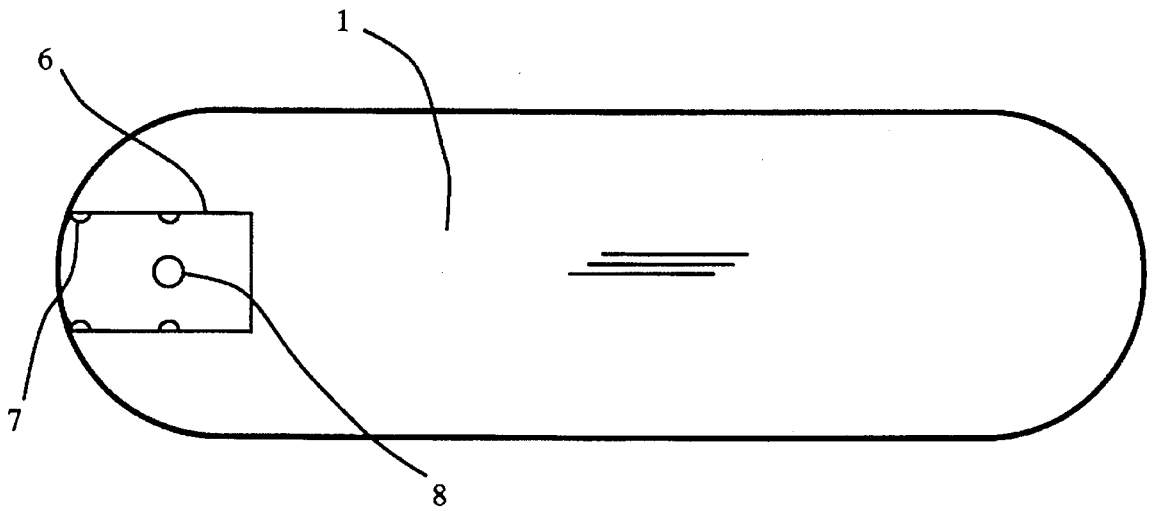
FIG. 2 is a top view of the preferred embodiment looking down the length of the illuminated writing device slot
Figure 3:
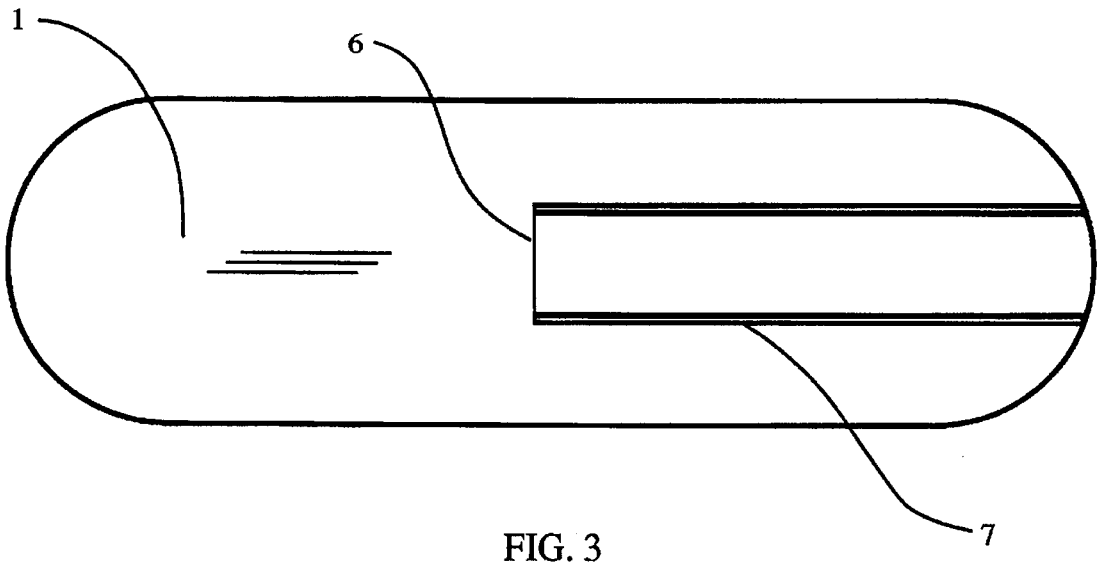
FIG. 3 is a side view of the preferred embodiment looking into the length of the illuminated writing device slot

The padding 1 of FIG. 2 as seen from the top has a notch 6 at one end to allow insertion and removal of an illuminated writing device or the like. The size of the notch 6 could vary to allow for different sized writing devices. The semicircular ridges 7 secure the writing device in place while the device is not in use. A cone shaped hole 8 at the floor of the notch 6 encloses the tip of the writing device to prevent the writing device from potential leaks of the type associated with ink pens and the like. The notch 6 shown in the side view of FIG. 3 continues down the side of the padding 1 allowing for the side insertion and removal of the writing device. The length of the notch 6 could vary to allow for different sized writing devices. The semicircular ridges 7 run the length of the notch 6.

Figure 4:
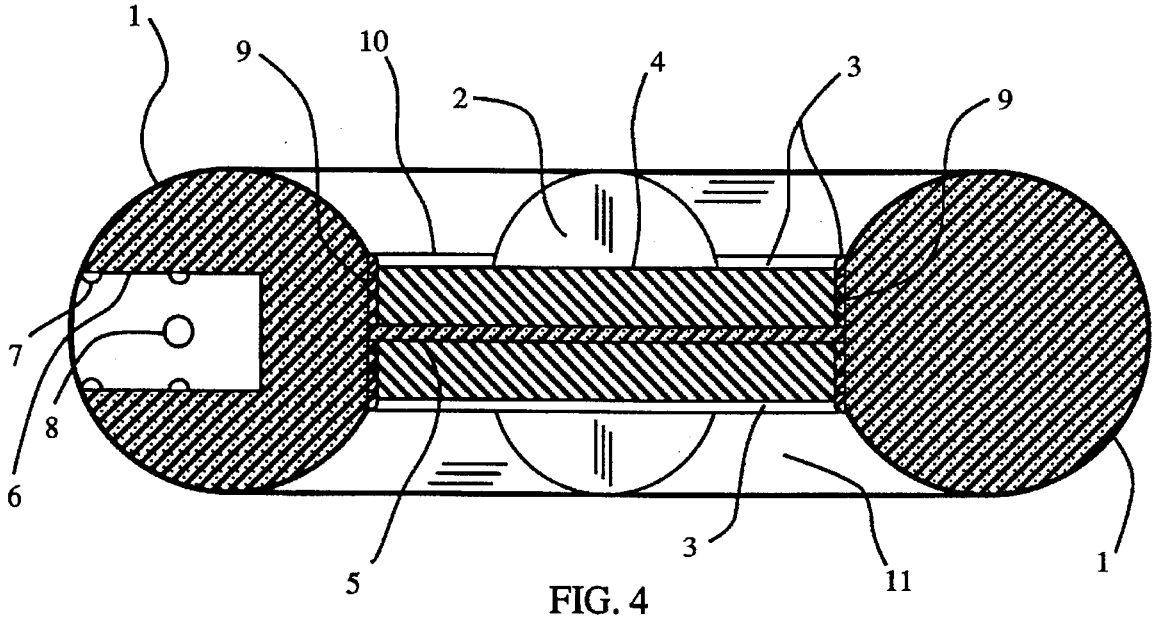
FIG. 4 is a cut-away view of the preferred embodiment showing a cross-section of the two-sided, note pad cradles with semicircular, ridge lined sides, as well as, the illuminated writing device slot. In addition.

The padding 1 of FIG. 4 is shown as a cut-a-way A—A displayed in FIG. 1. The notch 2 can be seen passing through the diameter of the far pad 11. The two sides of the cradle webbing 5 are shown supporting two note pads 4. The note pads 4 are held in place by the ridges 3 running the length of the cradle walls 9 and aligned in rows up the sides of said cradle walls.

Figure 5:
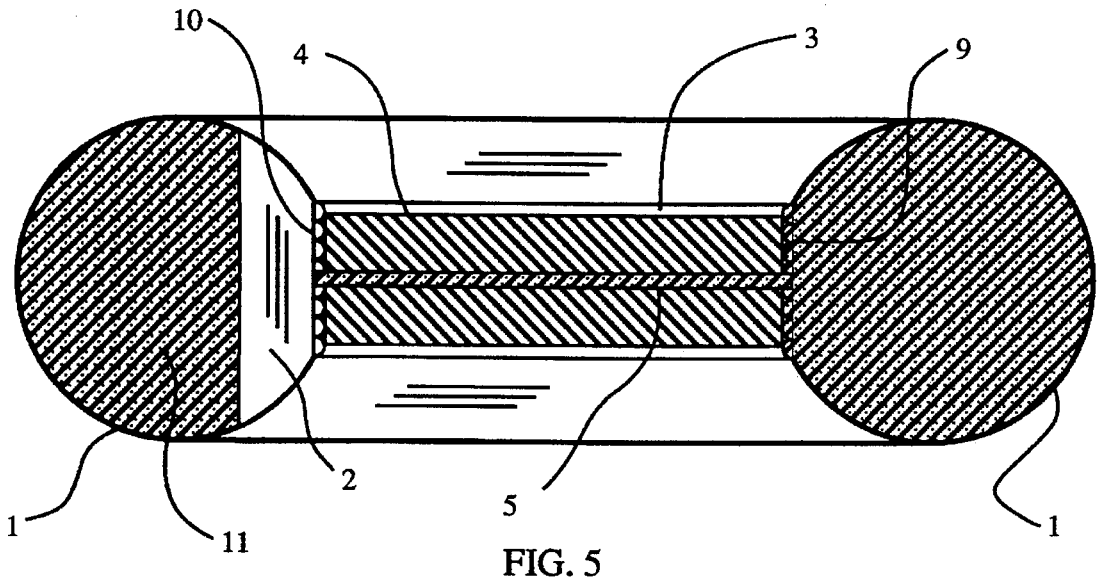
FIG. 5 is a cut-away of the preferred embodiment showing a cross-section of the two-sided, note pad cradles with semicircular, ridge lined sides, as well as, the thumb notch traversing a portion of one pad.

FIG. 5 shows a cut-a-way B—B displayed in FIG. 1 that is perpendicular to cut-a-way A—A in FIG. 4. The cradle walls 9, the cradle floor web 5, and the ridges 3 are shown supporting the note pads 4. The notch 2 is shown traversing the inner side of the pad 11 allowing access to both note pads 4.

Other ways in which the invention may be used include:

As a note taking device during ground travel. The note pad holder would be placed in a convenient to reach area of an automobile and utilized at will.

As a note taking device during air travel. The note pad holder would be placed inside carry-on luggage and used at will. The illuminated writing device would allow for use during times when darkness was needed in the cabin of the aircraft.

I claim:

1. A holder in combination with sheet material, said sheet material comprising a plurality of substantially rectangular sheets having a length and a width, said holder comprised of a rubber-like, flexible rectangular base of varying size with a rectangular cutout in the center of said base, with the remaining base material, a continuous form having an isometric cross-section of varying shape and size to make up the padded frame of said holder, said padded frame including a webbing to replace the cutout area in the center of the padded frame to support said sheet materials from either side of said holder, the webbing being of variable thickness and connected at varying depths along the dimension of the padded frame which is perpendicular to the plane of the base, said webbing may be integrated with said padded frame as part of the same molded member.

2. The combination of claim 1 wherein the inner sides of the padded frame meet the webbing at right angles as to form a cradle on one or both sides of the webbing, the walls of said cradle being lined with protruding ridges of varying size, shape and orientation for the purpose of holding said sheet material securely in place, said ridges may be integrated with said padded frame as part of the same molded member.

3. The combination of claim 1 further including a notch of variable size and shape passing through the inner portion of one side of the padded frame perpendicular to the plane of the base, said notch giving access to a portion of the edge of one side of the webbing floor, as well as, a portion of the edge of said sheet material.

4. The combination of claim 1 further including a notch of varying size located in the padded frame allowing for the storage of a variably sized writing device while it is not in use, said notch having at least one of its ends enclosed by the existing padded frame to form a stopping surface for the writing device during insertion.

5. The combination of claim 4 wherein the walls of said notch are lined with protruding ridges of varying size, shape and orientation for the purpose of holding said writing device securely in place, said ridges may be integrated with said notch as part of the same molded member.

6. The combination of claim 4 wherein the end of the notch enclosed by the existing padded frame surrounds a hole of varying shape and size to cap the writing end of the writing device while stored in the notch, said hole preventing potential leakage like that associated with liquid based writing materials.

* * * * *